US006990884B2

(12) United States Patent
Tseng

(10) Patent No.: US 6,990,884 B2
(45) Date of Patent: Jan. 31, 2006

(54) VERTICAL ROTARY MULTI-FUNCTIONAL TRIMMING APPARATUS

(75) Inventor: Tzu-Feng Tseng, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 10/709,548

(22) Filed: May 13, 2004

(65) Prior Publication Data

US 2005/0172774 A1 Aug. 11, 2005

(30) Foreign Application Priority Data

Feb. 6, 2004 (TW) ..... 93102832 A

(51) Int. Cl.
*B26D 1/18* (2006.01)

(52) U.S. Cl. ..... 83/618; 83/614; 83/698.41

(58) Field of Classification Search ..... 83/614, 83/698.41, 955

See application file for complete search history.

(56) References Cited

U.S. PATENT DOCUMENTS

| | | | | |
|---|---|---|---|---|
| 5,611,255 | A * | 3/1997 | Evans | 83/614 |
| 5,927,175 | A * | 7/1999 | Franks et al. | 83/883 |
| 2005/0109180 | A1 * | 5/2005 | Schultz et al. | 83/455 |

FOREIGN PATENT DOCUMENTS

| | | |
|---|---|---|
| GB | 1141951 | 2/1969 |
| GB | 1479645 | 7/1977 |
| GB | 2364666 A | 6/2002 |
| WO | WO99/58305 A1 | 11/1999 |

* cited by examiner

*Primary Examiner*—Charles Goodman
(74) *Attorney, Agent, or Firm*—Winston Hsu

(57) ABSTRACT

A vertical rotary trimming apparatus includes a base for placing material, a rail mounted on the base, a plurality of trimming elements for trimming the material, a carriage slidably mounted on the rail, an engagement device including a plurality of engagement units, and a fixer for engaging with the engagement units of the engagement device in order to fix the positions of the engagement device and the plurality of trimming elements. The plurality of trimming elements are rotatably connected to the engagement device, and the engagement device can actuate the plurality of trimming elements by rotating on a plane perpendicular to the base.

11 Claims, 15 Drawing Sheets

VERTICAL ROTARY MULTI-FUNCTIONAL TRIMMING APPARATUS

BACKGROUND OF INVENTION

1. Field of the Invention

The present invention relates to a trimming apparatus, and more particularly, to a vertical rotary multi-functional trimming apparatus.

2. Description of the Prior Art

As is well known, a paper cutter is a trimming apparatus for efficiently cutting paper into small sheets. Please refer to FIG. 1. FIG. 1 is a diagram of a prior art paper cutter. The conventional paper cutter 10 includes a base 11, a rail 12, a carriage 13 and a trimming element. The base 11 is for placing the material to be trimmed, the rail 12 is fixed on the base 11, and the carriage 13 is slidably mounted on the rail 12. The trimming element is mounted on the carriage 13 and is a single specific trimming element, such as a razor blade, that is comprised in the conventional paper cutter 10. When the paper is put into a gap between the rail 12 and the base 11, the user may press down the carriage 13 against the paper. By sliding the carriage 13 along the rail 12, the paper is cut into two pieces by the blade mounted on the carriage 13.

The conventional paper cutter mentioned above is specifically used to divide paper completely. In the case that paper is to be intermittently cut (or perforated) to be easily torn off by hand later or to be marked with a folding line to be easily folded by hand, another kind of trimmer will be needed for the specific requirement, which is thus cost-ineffective and space-inefficient. Accordingly, there are trimmers in the market that require the user to change different blades for different trimming effects. However, it is dangerous and inconvenient for users to change these blades.

Besides, it is very easy for the paper to become piled up (or jammed) when the blade slides on the paper due to the friction between the blade and the paper. This is another one of the flaws in the conventional desktop paper cutter. To avoid this drawback, there are products in which a guiding slit is positioned on the base along the track that the blade slides on. Though the design of the guiding slit may help to release the piling up problem of the paper, it increases the complexity of the paper cutter.

SUMMARY OF INVENTION

It is therefore a primary objective of the claimed invention to provide a vertical rotary multi-functional trimming apparatus.

Briefly described, the claimed invention discloses a vertical rotary trimming apparatus for trimming a material. The vertical rotary trimming apparatus includes a base for placing the material, a rail mounted on the base, a plurality of trimming elements for trimming the material, a carriage slidably mounted on the rail, an engagement device comprising a plurality of engagement units, and a fixer for engaging with the engagement units of the engagement device in order to fix the positions of the engagement device and the plurality of trimming elements. The plurality of trimming elements are rotatably connected to the engagement device, and the engagement device is capable of actuating the plurality of trimming elements by rotating on a plane perpendicular to the base.

It is an advantage of the present invention a plurality of different rotary trimming elements for rotating on the material and trimming the material are utilized. Different trimming functions may be switched easily in the present design. The problem of the material piling up or becoming jammed is avoided because the friction between the material and the trimming element due to the rotating of the trimming element is less than is due to the sliding of the trimming element.

These and other objectives of the present invention will no doubt become obvious to those of ordinary skill in the art after reading the following detailed description of the preferred embodiments that are illustrated in the various figures and drawings.

DETAILED DESCRIPTION

Figure 1:
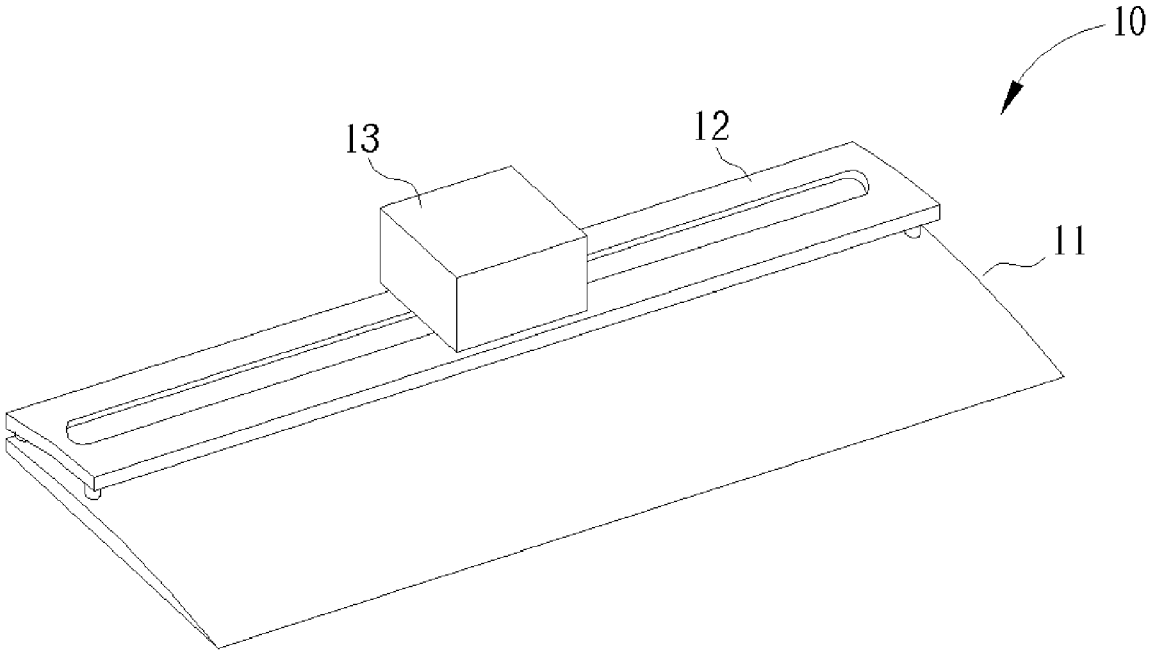
Fig. 1 Prior Art
FIG. 1 is a diagram of a prior art paper cutter.
Figure 2:
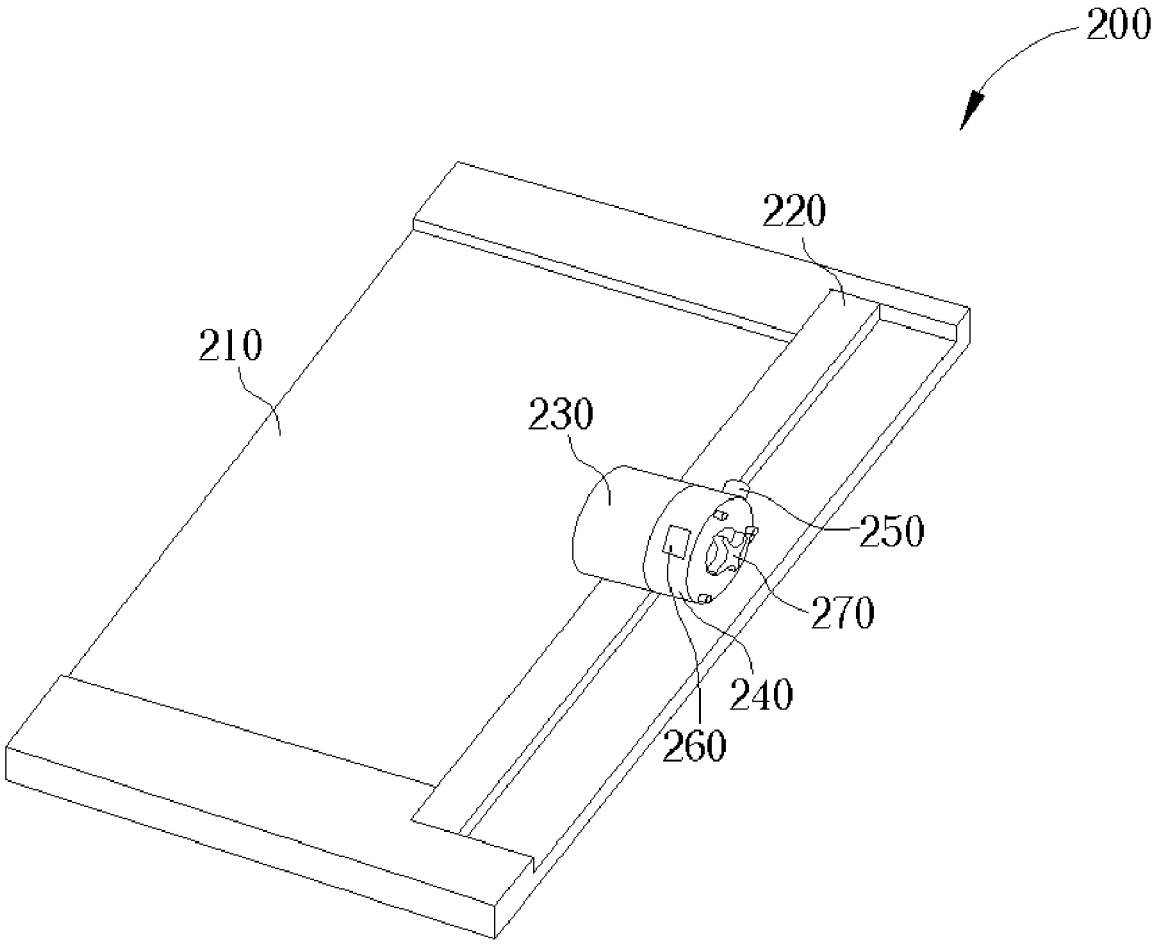
FIG. 2 is a diagram of a first embodiment of the present invention trimming apparatus.
Figure 3:
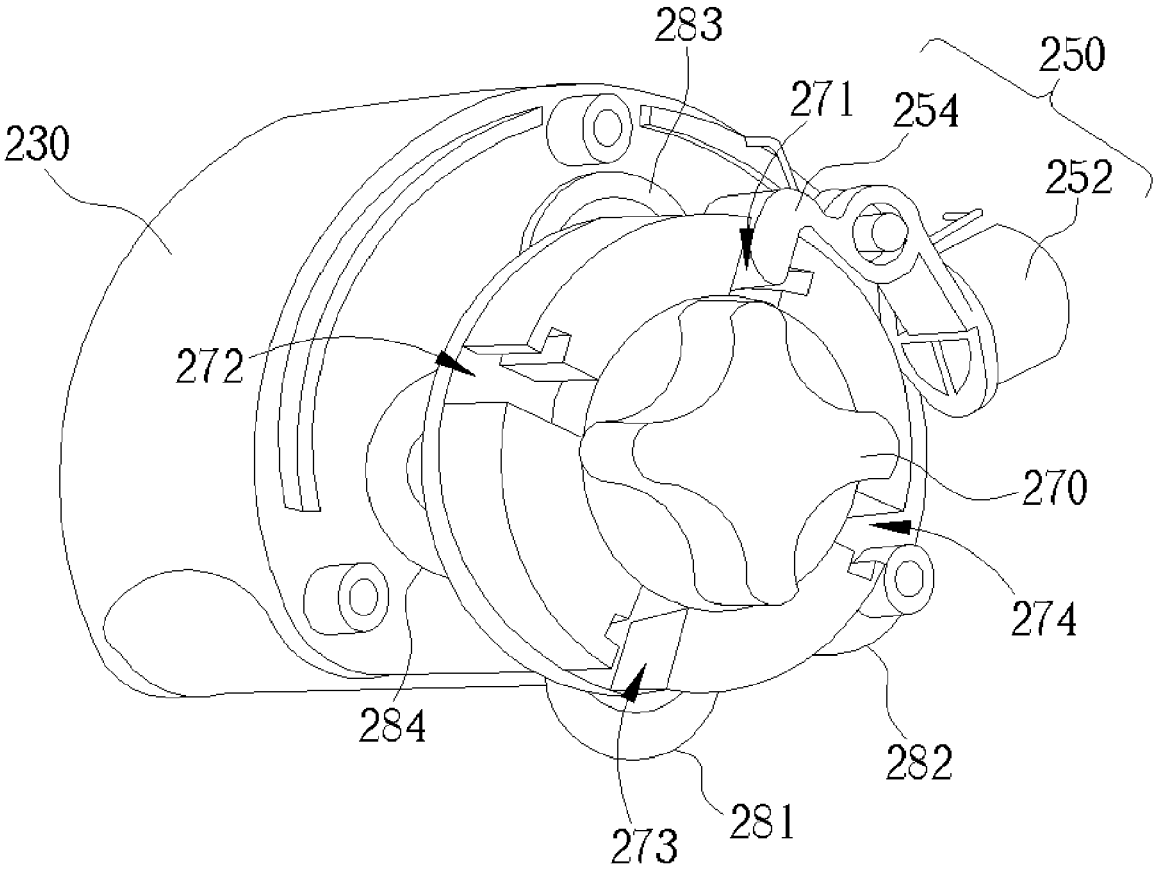
FIG. 3 is a partial diagram of the first embodiment of the present invention trimming apparatus.

Please refer to FIG. 2. FIG. 2 is a diagram of a first embodiment of the present invention trimming apparatus. FIG. 2 illustrates a trimming apparatus 200 comprising a base 210, a rail 220, a carriage 230 slidably mounted on the rail 220, an engagement device 270, a fixer 250, and a cover 240. The present invention is a multi-functional trimming apparatus including a plurality of different trimming elements, wherein the trimming elements are rotatably connected to the engagement device 270. The carriage 230 includes an observation window 260 for observing an indication on the engagement device 270 to allow indication of which trimming element is utilized by the trimming apparatus 200. Please refer to FIG. 3. FIG. 3 is a partial diagram of the trimming apparatus 200. In FIG. 3, the carriage 230, the engagement device 270, the fixer 250 and the plurality of trimming elements 281, 282, 283 and 284 are shown but the cover 240 in FIG. 2 is removed. The fixer 250 comprises a first unit 252 and a second unit 254. One end of the first unit 252 is fixed on the carriage 230 and another end is connected with the second unit 254. The engagement device 270 comprises four engagement units 271, 272, 273 and 274. Each of these four engagement units is a concavity (i.e. slot, hole, etc). The four trimming elements 281, 282, 283 and 284 are rotatably connected with the engagement device 270. As illustrated in FIG. 3, when the second unit 254 inserts into the concavity of the engagement unit 271 and engages with it, the positions of the engagement device 270 and the trimming elements 281, 282, 283 and 284 are all fixed. Therefore the trimming element 281 is exposed, and thus rotates on the material and trims the material when the carriage 230 slides along the rail 220.

Figure 4:
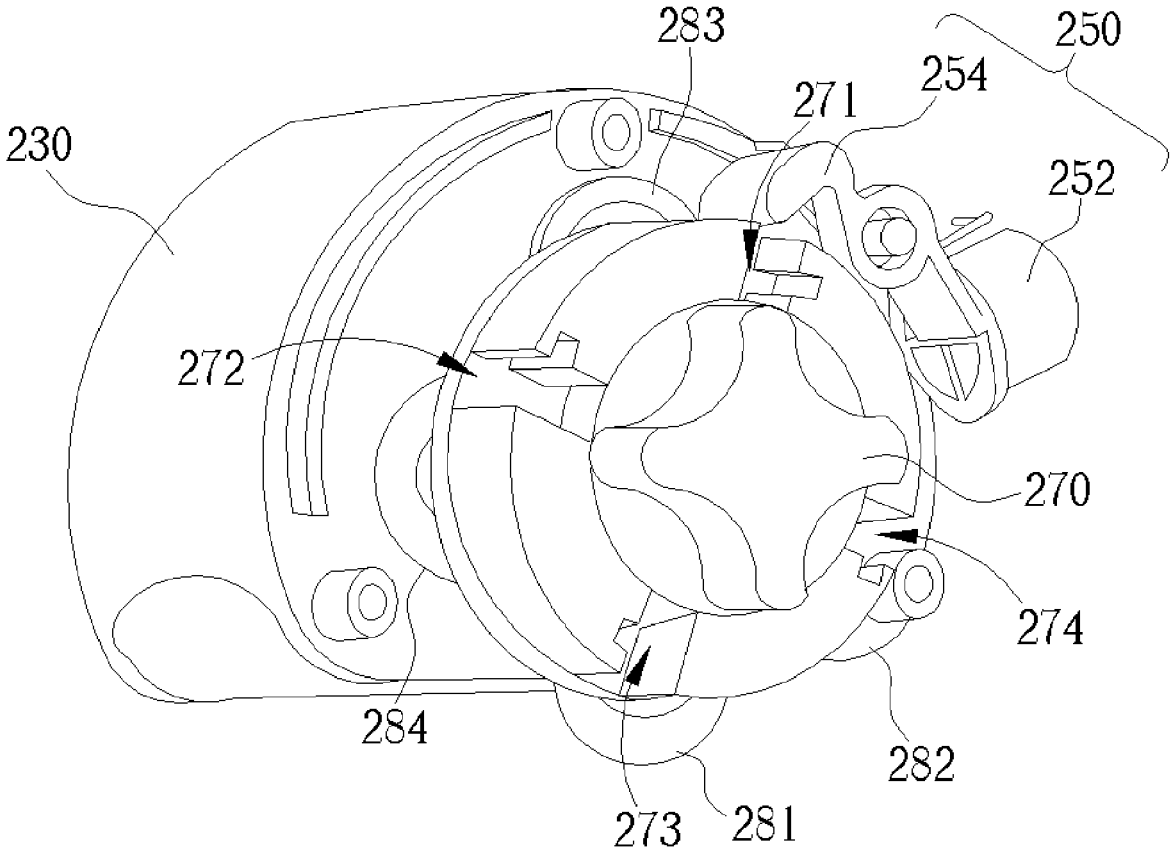
FIG. 4 is a partial diagram of the first embodiment of the present invention trimming apparatus when the first unit is pressed.

When a different trimming element is needed for a different trimming function, the first unit 252 included in the fixer 250 may be pressed down to raise the second unit 254 and disengage the second unit 254 from the engagement device. Consequently, the position of the engagement device 270 is not fixed, and the engagement device 270 may be rotated on a plane perpendicular to the base, hence the positions of the trimming elements 281, 282, 283 and 284 are shifted. Please refer to FIG. 4. Shown in FIG. 4, as the first unit 252 is pressed down, the second unit 254 is raised and disengaged from the engagement unit 271. At this moment the user may hold the cross-shaped holder of the engagement device 270 sticking out the cover 240 for rotating the engagement device 270 and changing the trimming element to be utilized accordingly. For instance, when the user rotates the engagement device 270 clockwise and turns the engagement unit 272 to the place under the second unit 254, the second unit 254 slips into the engagement unit 272, engages with it, and fixes the positions of the engagement device 270 and all the trimming elements. Therefore the trimming element 282 is exposed and is capable of rotating on the material for trimming it along with the sliding of the carriage 230. If a trimming element other than the trimming element 282 is desired, the user can repeat the aforementioned steps after the trimming element 282 is switched to, or the user may press down the first unit 252 continuously such that the second unit 254 remains raised until the target engagement unit is turned to under the second unit 254.

Figure 5:
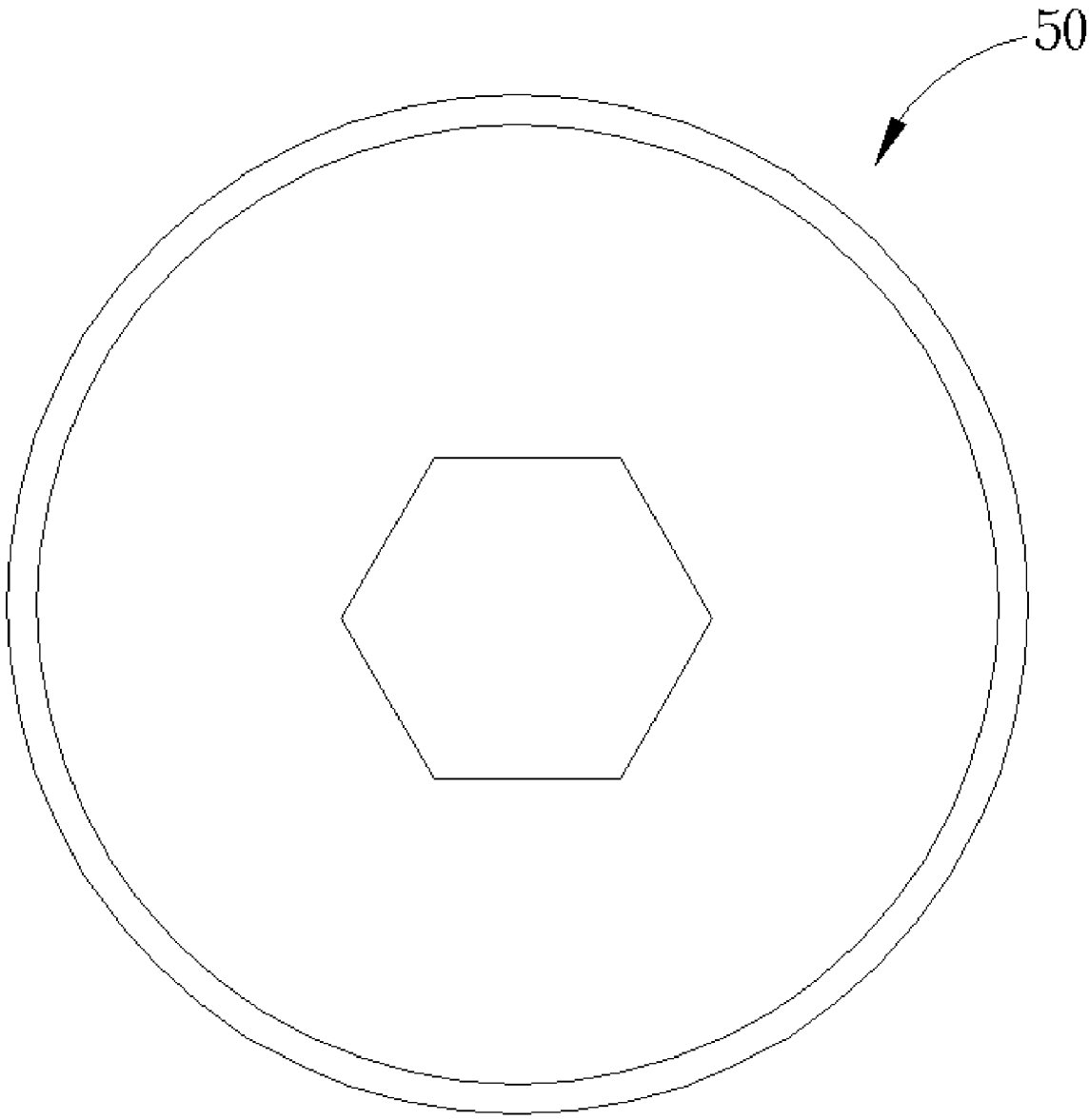
FIG. 5 is a diagram of a first trimming element included in the present invention trimming apparatus.
Figure 6:
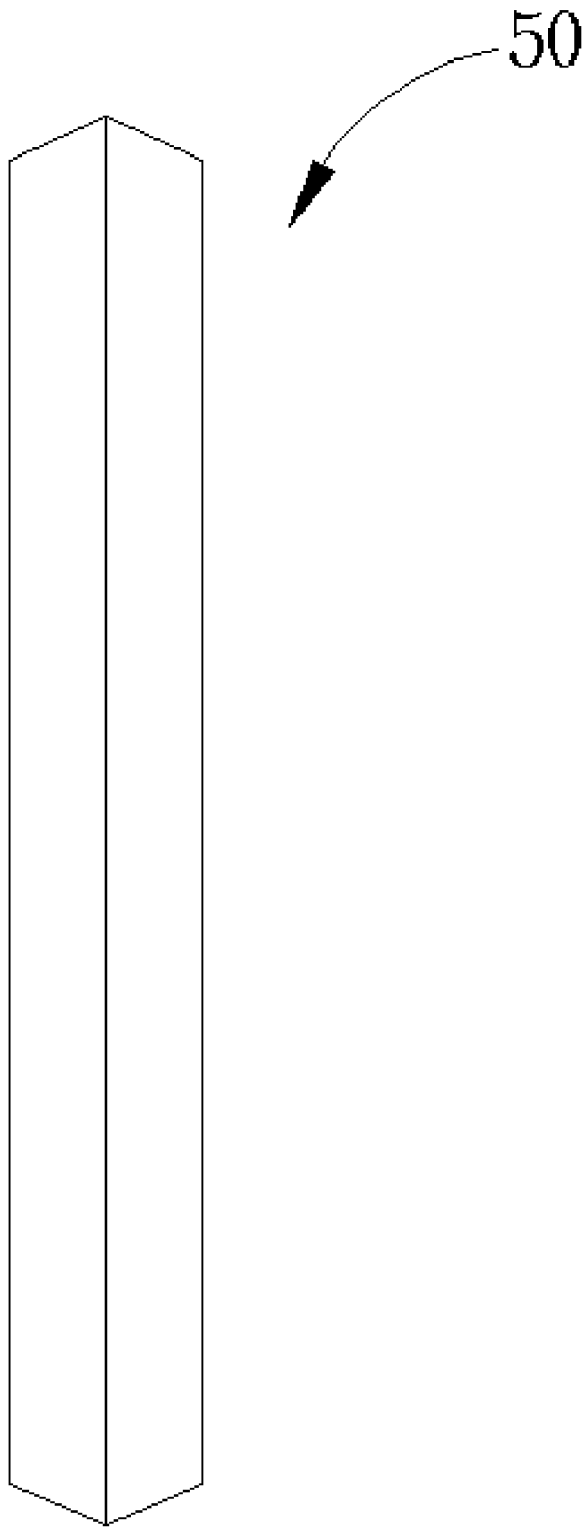
FIG. 6 is a side elevation of the first trimming element shown in FIG. 5.
Figure 7:
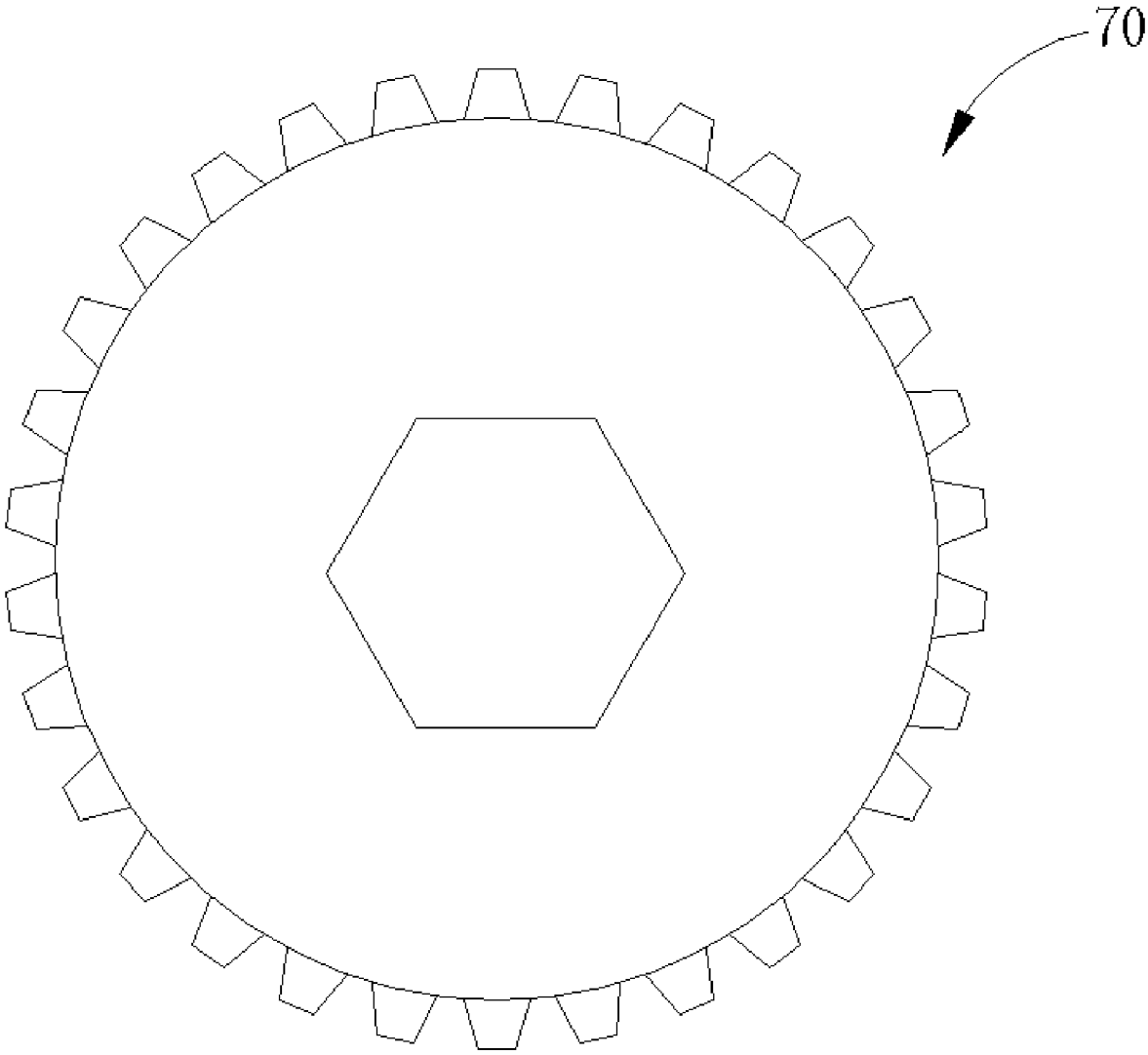
FIG. 7 is a diagram of a second trimming element included in the present invention trimming apparatus.
Figure 8:
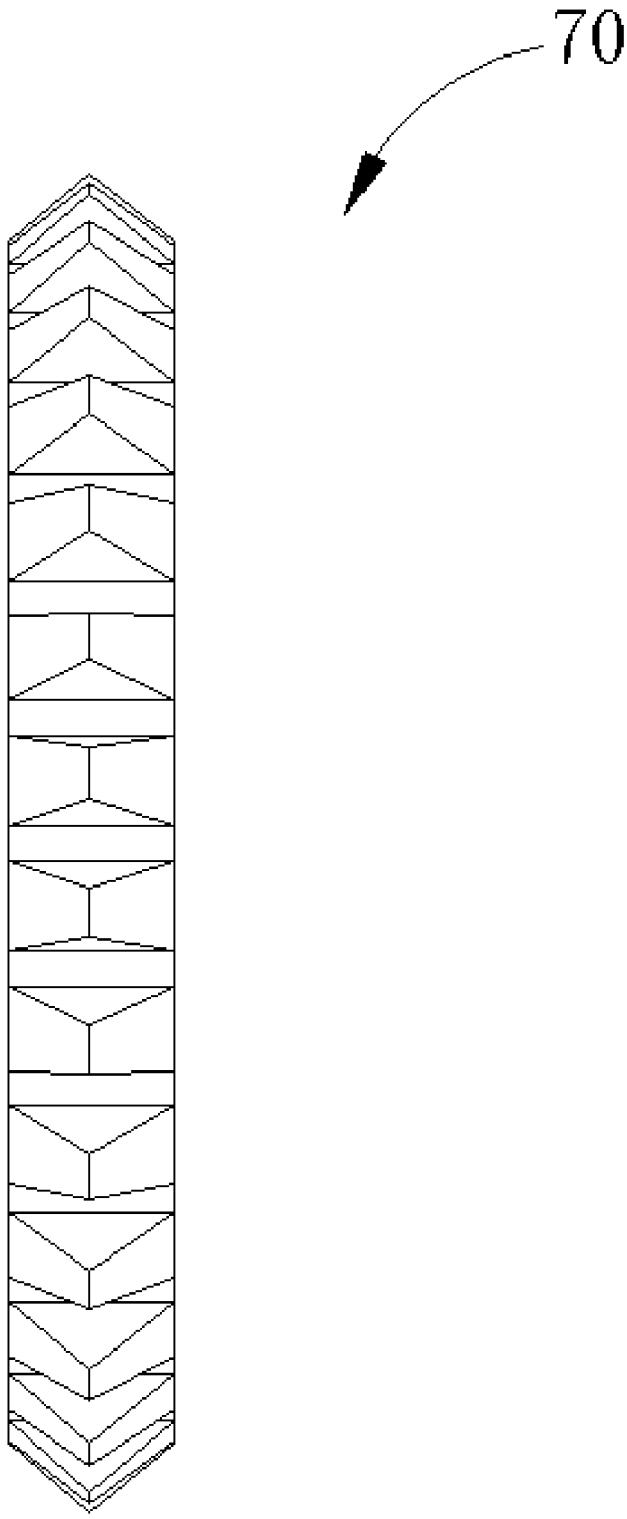
FIG. 8 is a side elevation of the second trimming element shown in FIG. 7.
Figure 9:
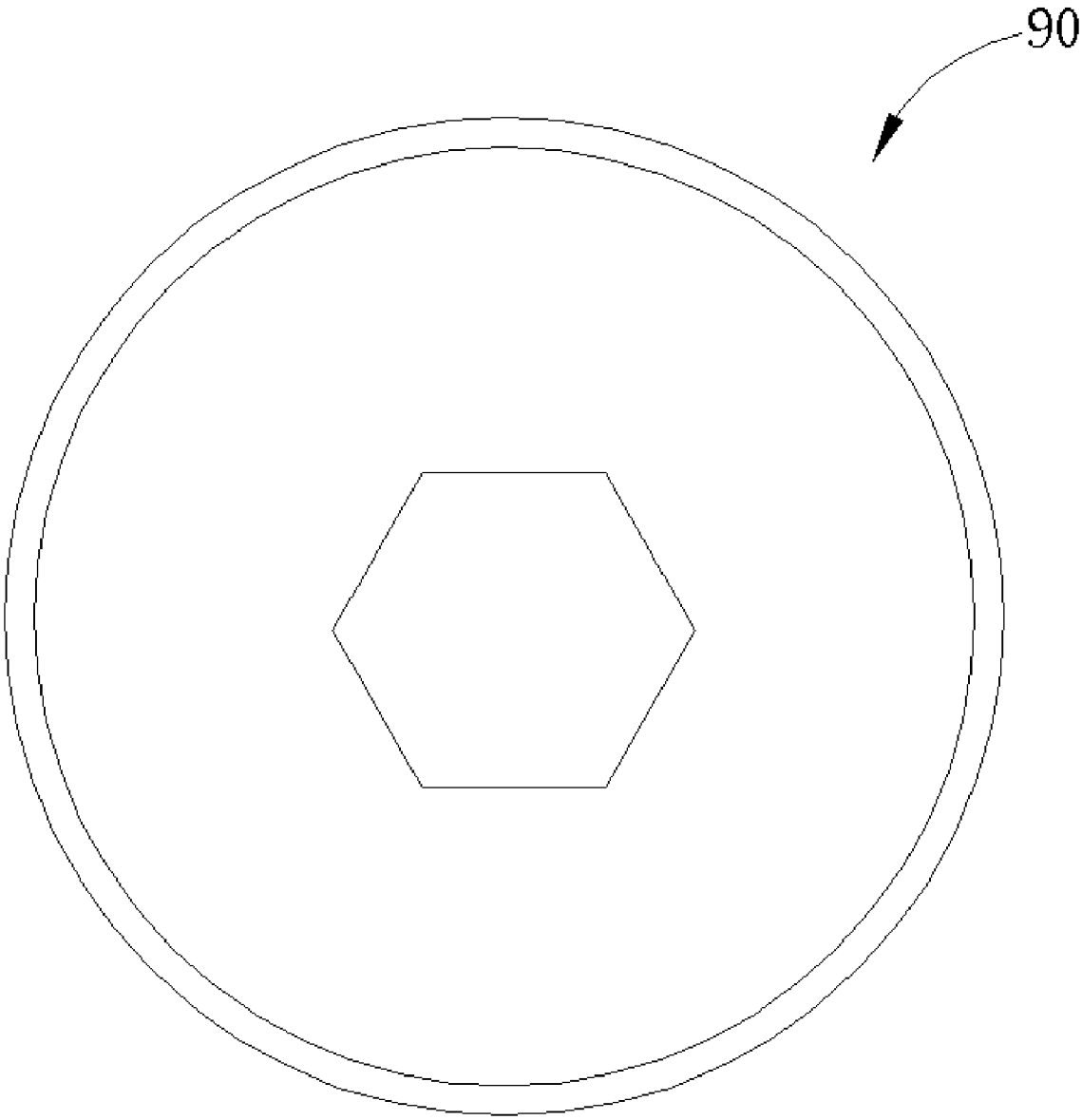
FIG. 9 is a diagram of a third trimming element included in the present invention trimming apparatus.
Figure 10:
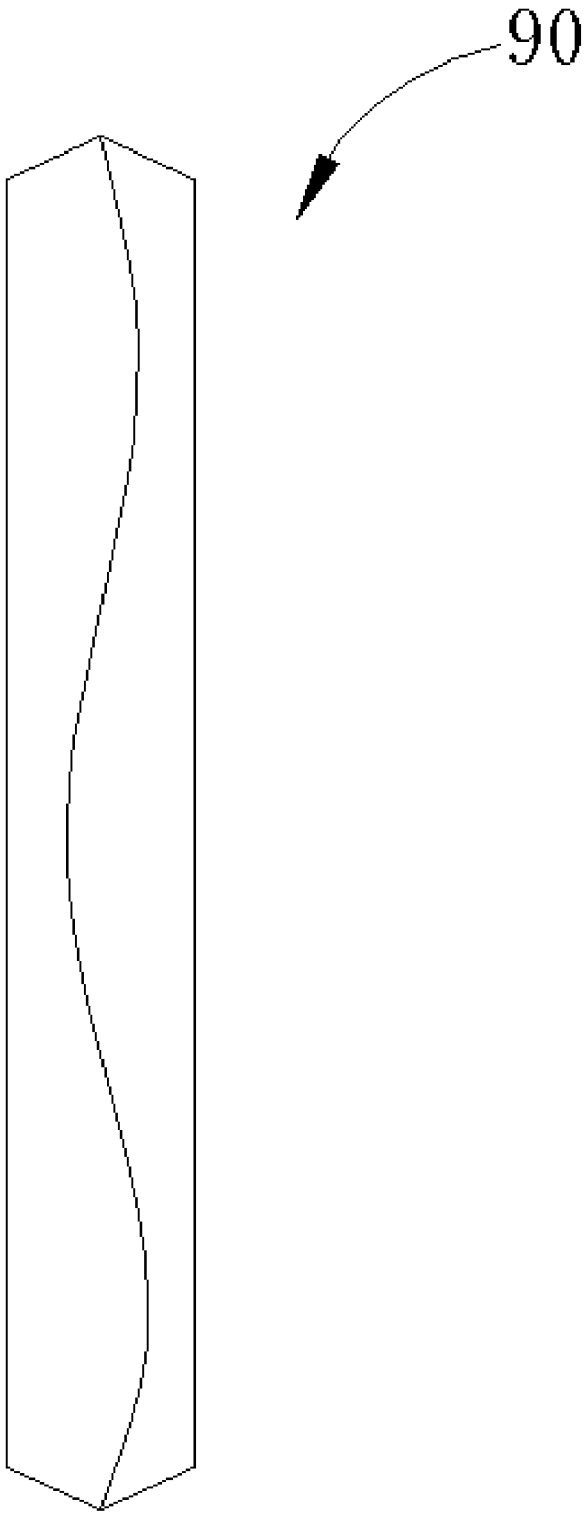
FIG. 10 is a side elevation of the third trimming element shown in FIG. 9.
Figure 11:
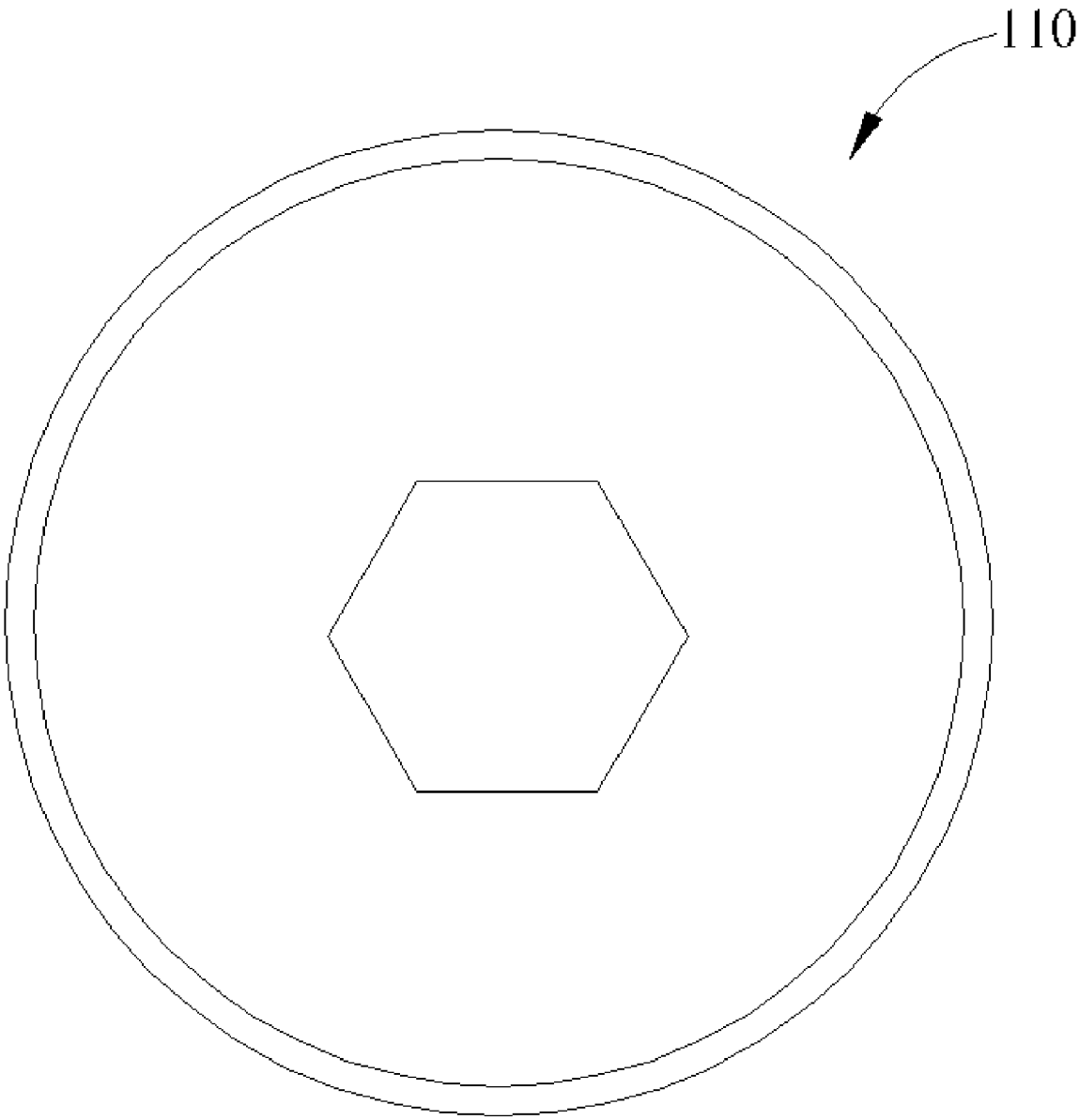
FIG. 11 is a diagram of a fourth trimming element included in the present invention trimming apparatus.
Figure 12:
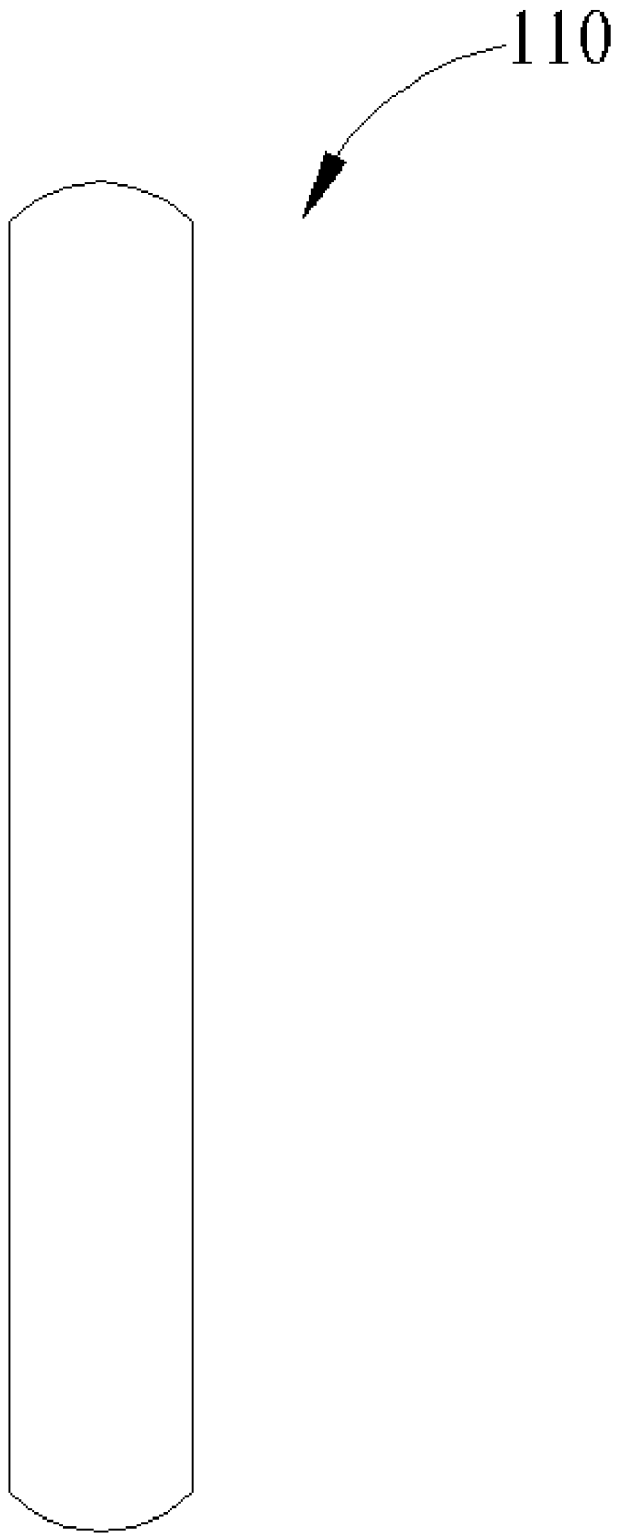
FIG. 12 is a side elevation of the fourth trimming element shown in FIG. 11.

The present invention is a rotary trimming apparatus in which the trimming elements rotate on the material. The rotation can reduce the friction between the trimming element and the material to be trimmed, and hence reduce the problem of piling up (or material jamming) in the conventional paper cutter. Please refer to FIG. 5. FIG. 5 is a diagram of a first trimming element 50 used in the present trimming apparatus. The first trimming element 50 is a rotary cutter, and the perimeter of the rotary cutter 50 is sharp. When the present trimming apparatus is switched to the rotary cutter 50, the rotary cutter 50 is capable of rotating on the material that is placed on the base and cutting the material apart as the carriage slides along the rail. FIG. 6 is a side elevation of the rotary cutter 50 in FIG. 5. Please refer to FIG. 7. FIG. 7 is a diagram of a second trimming element 70 included in the present trimming apparatus. The second trimming element 70 is a rotary gear-shaped blade, and the perimeter of the rotary gear-shaped blade 70 comprises sharp saw-teeth. When the present trimming apparatus is switched to the gear-shaped blade 70, the gear-shaped blade 70 is capable of rotating on the material that is placed on the base and cutting the material intermittently as the carriage slides along the rail. FIG. 8 is a side elevation of the gear-shaped blade 70 in FIG. 7. Please refer to FIG. 9. FIG. 9 is a diagram of a third trimming element 90 included in the present trimming apparatus. The third trimming element 90 is a rotary wavy-line cutter, and the perimeter of the rotary wavy-line cutter 90 is sharp and wavy. When the present trimming apparatus is switched to the rotary wavy cutter 90, the rotary wavy cutter 90 is capable of rotating on the material that is placed on the base and cutting the material apart in a wavy curve as the carriage slides along the rail. FIG. 10 is a side elevation of the rotary wavy cutter 90 in FIG. 9. Please refer to FIG. 11. FIG. 11 is a diagram of a fourth trimming element 110 included in the present trimming apparatus. The fourth trimming element 110 is a rotary blunt blade, and the perimeter of the rotary blunt blade 110 is arc-shaped. When the present trimming apparatus is switched to the rotary blunt blade 110, the rotary blunt blade 110 is capable of rotating on the material that is placed on the base and forming a folding line on the material as the carriage slides along the rail. FIG. 12 is a side elevation of the rotary blunt blade 110 in FIG. 11.

When using the present trimming apparatus, the user may need some indication of which trimming element is utilized for performing correct trimming. Please refer to FIG. 2. As illustrated above, the carriage 230 includes an observation window 260 for observing an indication on the engagement device 270 to allow indication of which trimming element is utilized by the trimming apparatus 200. The engagement device in the present invention further comprises a plurality of indications corresponding to the plurality of trimming elements, such that the user may observe the indication of which trimming element is utilized through the observation window 260.

Figure 13:
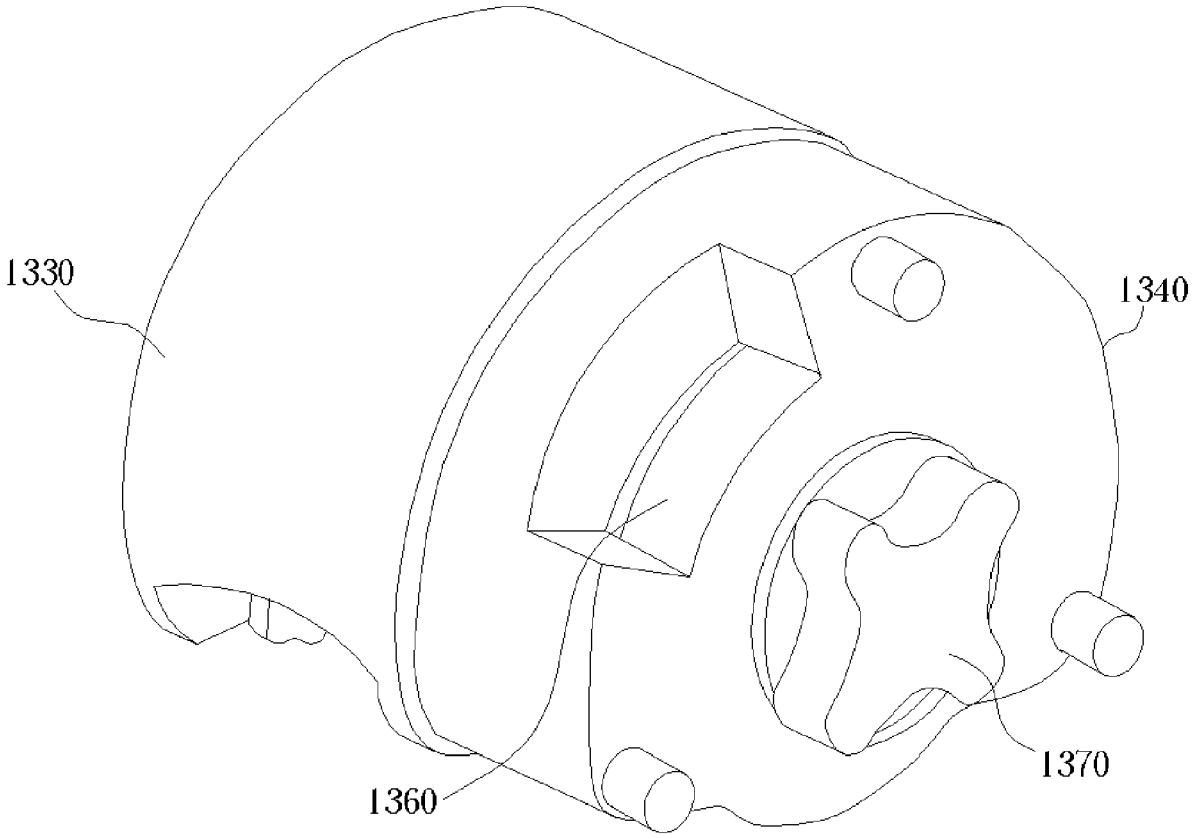
FIG. 13 is a partial diagram of a second embodiment of the present invention trimming apparatus.
Figure 14:
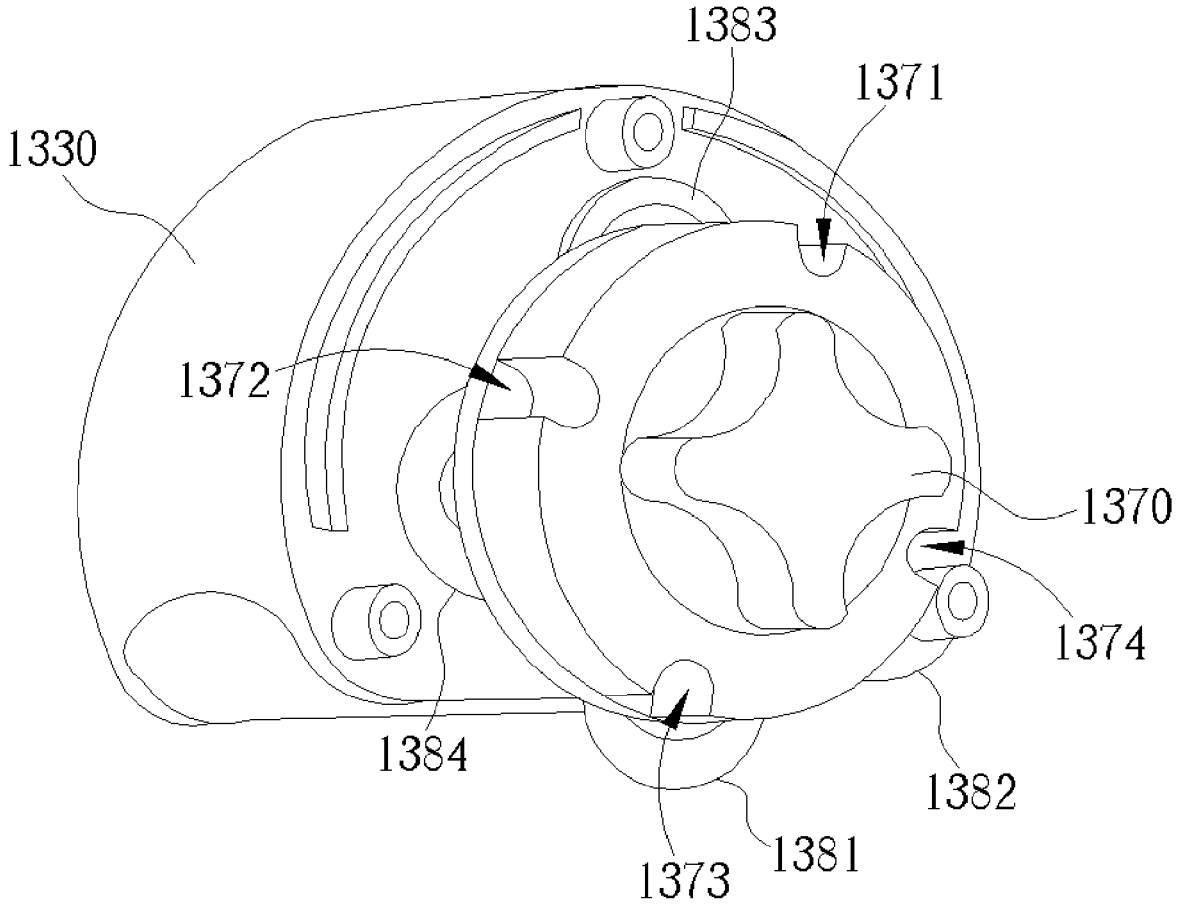
FIG. 14 is another partial diagram of the second embodiment of the present invention trimming apparatus.
Figure 15:
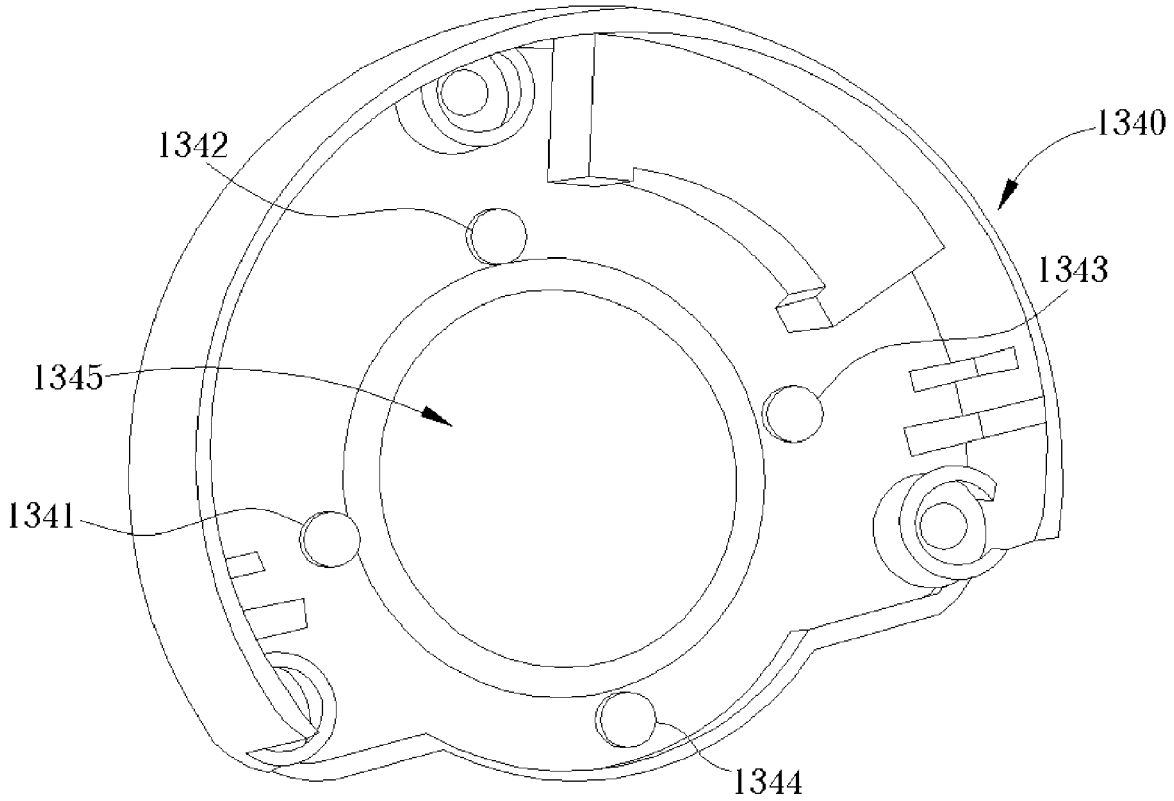
FIG. 15 is a diagram of a fixer included in the second embodiment of the present invention trimming apparatus.

Different fixers and different ways for engaging with the engagement device may be used in the present invention. Please refer to FIG. 13. FIG. 13 is a partial diagram of a second embodiment of the claimed trimming apparatus. A carriage 1330, an engagement device 1370, a cover 1340 and an observing window 1360 are illustrated in FIG. 13. The engagement device 1370 is further connected with a plurality of trimming elements. Please refer to FIG. 14. In FIG. 14, the carriage 1330, the engagement device 1370 and the plurality of trimming elements 1381, 1382, 1383 and 1384 are shown, but the cover 1340 is removed. The engagement device 1370 includes four engagement units 1371, 1372, 1373 and 1374, and each of these four engagement units is a concavity. The four trimming elements 1381, 1382, 1383 and 1384 are rotatably connected with the engagement device 1370. Please refer to FIG. 15. FIG. 15 is a diagram of a fixer 1340 included in the second embodiment of the claimed trimming apparatus. The fixer 1340 is simply the cover shown in FIG. 13. The illustration in FIG. 15 shows the inner side of the cover 1340. The fixer 1340 is connected on the carriage 1330 and comprises four fixing units 1341, 1342, 1343 and 1344. Each of these four fixing units is a prominent part. 1345 is a hole through which the cross-shaped holder of the engagement device 1374 extends out. When each of the fixing units inserts into an engagement unit separately and is engaged with the engagement unit, the positions of the engagement device 1370 and the four trimming elements 1381, 1382, 1383 and 1384 are fixed. Therefore one of the trimming elements is exposed and may rotate on the material and trim the material when the carriage 1330 slides along the rail.

There is a spring between the engagement device 1370 and the carriage 1330 in the second embodiment of the present invention. When a different trimming element is needed for a different trimming function, the user may press the engagement device 1370 against the carriage 1330 so the engagement device 1370 leaves the fixer 1340 and the engagement units are disengaged from the fixing units. Therefore the position of the engagement device 1370 is not fixed, and the user may hold the cross-shaped holder of the engagement device 1370 extending out the engagement device 1370 for changing the trimming element. For instance, assume that the engagements units 1371, 1372, 1373 and 1374 are engaged with the fixing units 1342, 1343, 1344 and 1341 respectively, and the trimming element 1381 is exposed so that the trimming element 1381 may rotate on the material and trim the material as the carriage 1330 slides along the rail. When the engagement device 1370 is pressed down and is rotated clockwise, and the engagement units 1371, 1372, 1373 and 1374 are rotated to the positions corresponding to the fixing units 1341, 1342, 1343 and 1344 respectively, and the fixing units 1341, 1342, 1343 and 1344 will slip into the engagement units 1371, 1372, 1373 and 1374 and engage with the engagement units 1371, 1372, 1373 and 1374 respectively. Hence the positions of the engagement device 1370 and the trimming elements are fixed, such that the trimming element 1382 is exposed and may rotate on the material and trim the material as the carriage 1330 slides along the rail. Similarly, if a trimming element other that the trimming element 1382 is desired, the aforementioned steps can be repeated after the trimming element 1382 is switched on, or the user may press down the engagement device 1370 and rotate it continuously until the target trimming element is exposed so that the fixing units are engaged with the engagement units in order for fixing the positions of the engagement device and the trimming elements.

The present invention provides a practical multifunctional trimming apparatus. The trimming apparatus supports cutting, intermittent cutting, cutting in a wavy curve and forming a folding line. In contrast to the prior art, each trimming element trims the material in a rotary way, so the flaw of material piling up or becoming jammed due to the friction of the sliding of the trimming element is avoided. Different engagements of the fixer and the engagement device may be utilized to fix and switch the trimming elements. In addition, the design of the observing window allows indication of which trimming element is utilized.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A vertical rotary trimming apparatus for trimming a material comprising:

a base for placing the material;

a rail mounted on the base;

a plurality of trimming elements for trimming the material;

a carriage slidably mounted on the rail;

an engagement device, wherein the plurality of trimming elements are rotatably connected to the engagement device, the engagement device capable of actuating the plurality of trimming elements by rotating on a plane perpendicular to the base, and the engagement device comprising a plurality of engagement units; and a fixer for engaging with the engagement units of the engagement device in order to fix the positions of the engagement device and the plurality of trimming elements, the fixer comprising:

a first unit fixed on the carriage; and a second unit, wherein one end of the second unit is connected with the first unit and the other end of the second unit is for engaging with an engagement unit of the engagement device in order to fix the positions of the engagement device and the plurality of trimming elements.

2. The apparatus of claim 1 in which the engagement unit is a concavity, wherein the second unit inserts into the concavity for fixing the positions of the engagement device and the plurality of trimming elements when the second unit is engaged with the engagement unit.

3. The apparatus of claim 1 wherein the second unit is engaged with the engagement unit when the first unit is at a first position, and the second unit is disengaged from the engagement unit when the first unit is at a second position.

4. The apparatus of claim 1 wherein the plurality of trimming elements comprises a first trimming element, and the perimeter of the first trimming element is sharp.

5. The apparatus of claim 1 wherein the plurality of trimming elements comprises a second trimming element, and the perimeter of the second trimming element comprises sharp saw-teeth.

6. The apparatus of claim 1 wherein the plurality of trimming elements comprises a third trimming element, and the perimeter of the third trimming element is wavy.

7. The apparatus of claim 1 wherein the plurality of trimming elements comprises a fourth trimming element, and the perimeter of the fourth trimming element is arc-shaped.

8. The apparatus of claim 1 wherein the engagement device further comprises a plurality of indications corresponding to the plurality of trimming elements, and the carriage comprises an observation window for observing an indication on the engagement device to allow indication of which trimming element is utilized.

9. A vertical rotary trimming apparatus for trimming a material comprising:

a base for placing the material;

a rail mounted on the base;

a plurality of trimming elements for trimming the material;

a carriage slidably mounted on the rail;

an engagement device, wherein the plurality of trimming elements are rotatably connected to the engagement device, the engagement device capable of actuating the plurality of trimming elements by rotating on a plane perpendicular to the base, and the engagement device comprising a plurality of engagement units; and a fixer for engaging with the engagement units of the engagement device in order to fix the positions of the engagement device and the plurality of trimming elements, the fixer connected to the carriage and comprising:

a plurality of fixing units for engaging with the plurality of engagement units in order to fix the positions of the engagement device and the plurality of trimming elements when the plurality of fixing units are engaged with the plurality of engagement units, and in order to enable the engagement device to rotate opposite to the fixer when the plurality of fixing units are disengaged from the plurality of engagement units.

10. The apparatus of claim 9 wherein each fixing unit is a prominent part and each engagement unit is a concavity.

11. The apparatus of claim 9 wherein each fixing unit is a concavity and each engagement unit is a prominent part.

* * * * *